United States Patent [19]

Wafler

[11] Patent Number: 4,938,468

[45] Date of Patent: Jul. 3, 1990

[54] NON-ROTATING PAPER PATH IDLER

[75] Inventor: Walter F. Wafler, Rochester, N.Y.

[73] Assignee: Xerox Corporation, Stamford, Conn.

[21] Appl. No.: 790,928

[22] Filed: Oct. 24, 1985

[51] Int. Cl.[5] ..... B65H 5/02

[52] U.S. Cl. ..... 271/272; 271/274

[58] Field of Search ..... 271/272, 277, 119, 120, 271/121, 124, 19, 9, 31, 263, 274; 198/781, 785

[56] References Cited

U.S. PATENT DOCUMENTS

| | | | |
|---|---|---|---|
| 3,593,989 | 7/1971 | Crittenden et al. | 271/262 X |
| 3,606,309 | 9/1971 | Petrick et al. | 271/272 X |
| 4,089,516 | 5/1978 | Colgozier et al. | 271/9 |
| 4,175,741 | 11/1979 | Colgozier et al. | 271/3.1 |
| 4,362,409 | 12/1982 | Endo et al. | 400/625 |
| 4,420,151 | 12/1983 | Kobayashi | 271/263 |
| 4,465,272 | 8/1984 | Kajita et al. | 271/274 |
| 4,573,673 | 3/1986 | Haug | 271/265 X |

OTHER PUBLICATIONS

Brown, C. G.,"Antitreeing Device for Paper Feed Mechanisms", IBM Tech, Discl. Bulletin, vol. 15, No. 7, p. 2311 (Dec. 1977).

*Primary Examiner*—Andres Kashnikow
*Assistant Examiner*—Matthew C. Graham
*Attorney, Agent, or Firm*—H. Fleischer; J. E. Beck; R. Z. Zibelli

[57] ABSTRACT

An apparatus in which an advancing sheet is guided along a paper path. The apparatus includes a non-rotating, arcuate member, positioned closely adjacent to a drive roller, defining a nip through which the advancing sheet moves. The arcuate member resiliently urges the sheet into contact with the drive roller to move the sheet between adjacent guide plates along the sheet path.

12 Claims, 2 Drawing Sheets

NON-ROTATING PAPER PATH IDLER

Figure 1:
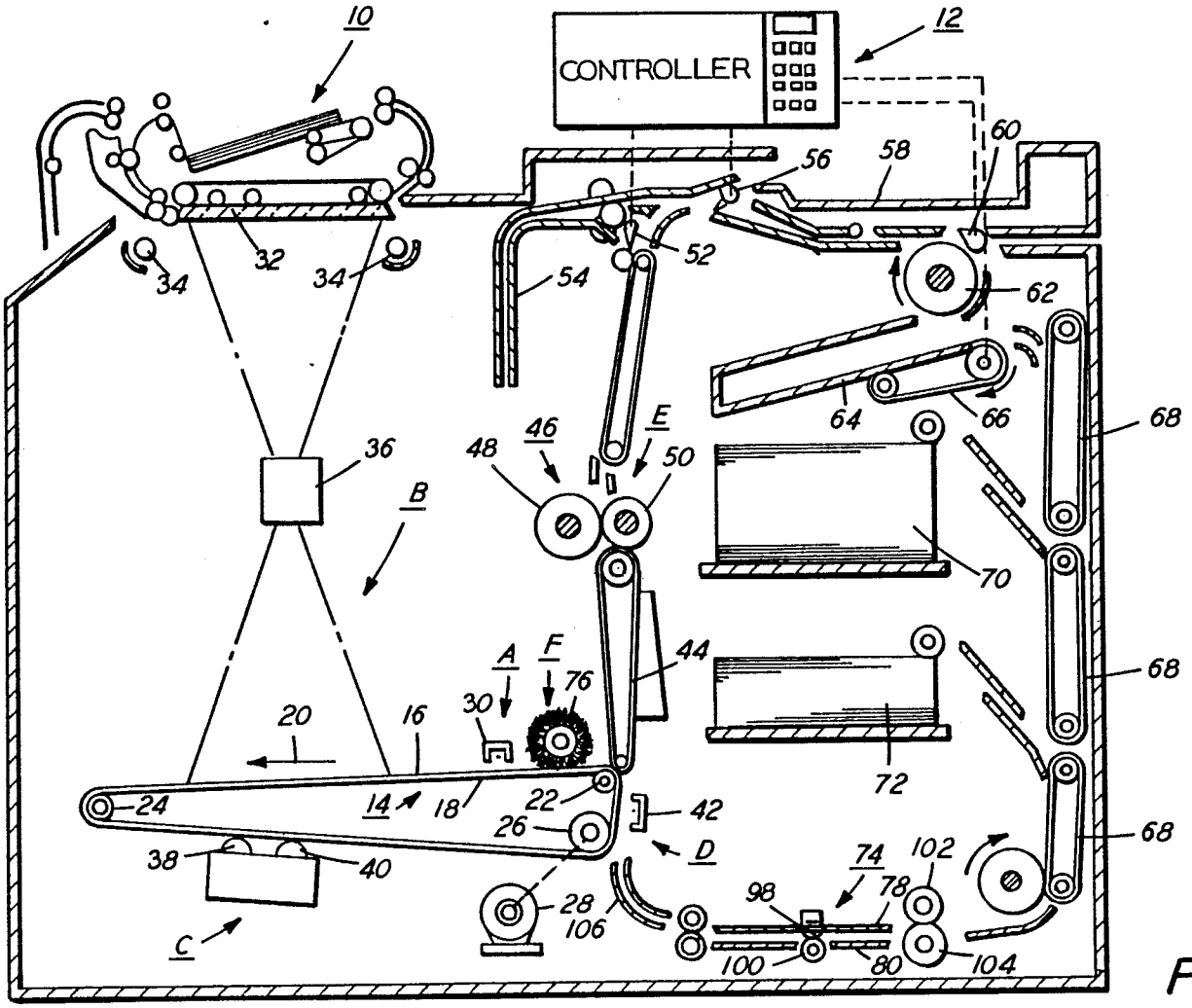

This invention relates generally to an electrophotographic printing machine, and more particularly concerns an apparatus for advancing a sheet along a selected sheet path therein.

In a typical electrophotographic printing machine, the photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The copy sheet is then advanced to the fusing station so as to permanently affix the powder image thereto. In the electrophotographic printing machine, the copy sheet is advanced along a sheet path from a sheet support tray to the transfer station, fusing station and to the catch tray for subsequent removal therefrom by the machine operator. Various types of guides are employed to insure that the copy sheet remains within the sheet path and is maintained at the requisite speed so as to arrive at the respective processing stations at the appropriate time in the machine cycle. Hereinbefore, a drive roller and an idler roller were employed to advance the copy sheet along the sheet path. Idler rollers having moving parts which tend to wear out and fail. Also, idler rollers occasionally squeak because of lack of lubrication between the shaft and the rotating roller. In addition, idler rollers are relatively complex and expensive. Commercial electrophotographic printing machines are continuously striving to reduce the cost of the various subcomponents contained therein. Only in this way will the product remain competitive. Not only must the cost of the product be reduced, but the reliability must be increased. One area where the cost may be reduced and reliability increased, is in the sheet path. Thus, it is highly desirable to improve the reliability and quality while reducing the cost of the apparatus employed to advance the sheet along a selected path in an electrophotographic printing machine.

Hereinbefore, various approaches have been devised for advancing sheets. The following disclosures appear to be relevant: U.S. Pat. No. 4,089,516 Patentee: Colglazier et al. Issued: May 16, 1978; U.S. Pat. No. 4,175,741 Patentee: Colglazier et al. Issued Nov. 27, 1979; U.S. Pat. No. 4,362,409 Patentee: Endo et al. Issued: Dec. 7, 1982; U.S. Pat. No. 4,420,151 Patentee: Kobayashi Issued: Dec. 13, 1983.

The relevant portions of the foregoing disclosures may be briefly summarized as follows:

Colglazier et al. ('516) and ('741) disclose a sheet feeder having a combing wheel engaging the uppermost sheet of a stack for shingling so as to position the leading edge thereof in the nip formed by a friction feed roller and pivoted pressure pads. The feed roller advances the shingled sheet from the stack. Both the combing wheel and feed roll rotate continuously.

Endo describes an automatic sheet feeding apparatus used in a printing apparatus. The sheet feeding apparatus includes a sheet feeding roller which rotates during automatic sheet feeding and remains stationary during manual sheet feeding. During automatic sheet feeding, the sheet feeding roller moves the sheet to the nip formed between the platen and finishing roller, both of which are not rotating. The sheet stops and the leading edge thereof is aligned. The platen and a pair of sheet ejecting rollers are energized to rotate. This moves the sheet forward while being held by the platen and a pinch roller. When the leading edge of the sheet passes a printing head a paper bail is set, and when, a detector senses the leading edge of the sheet, the direction of rotation of the platen is reversed to move the sheet rearwardly a specified distance to start printing.

Kobayashi describes a multiple sheet detection device. The sheets advance to a gap of a size sufficient to permit one sheet to pass therethrough. Drive rollers are held stationary when a single sheet passes through the gap. The drive rollers are released and permitted to rotate when more than one sheet passes through the gap.

In accordance with one aspect of the features of the present invention, there is provided an apparatus for guiding and advancing sheets. The apparatus includes a drive roller and a non-rotating, arcuate member positioned closely adjacent to the drive roller to define a nip through which the advancing sheet moves. Means are provided for resiliently urging the arcuate member into engagement with the sheet to press the sheet against the drive roller so that the sheet is advanced through the nip defined by the arcuate member and the drive roller.

Pursuant to another aspect of the present invention, there is provided an electrophotographic printing machine of the type in which successive copy sheet are guided and advanced to the processing stations therein. The printing machine includes a drive roller and a non-rotating, arcuate member positioned closely adjacent to the driver roller to define a nip through which the advancing sheet moves. Means are provided for resiliently urging the arcuate member into engagement with the sheet to press the sheet against the drive roller so that the sheet is advanced through the nip defined by the arcuate member and the drive roller.

Figure 2:
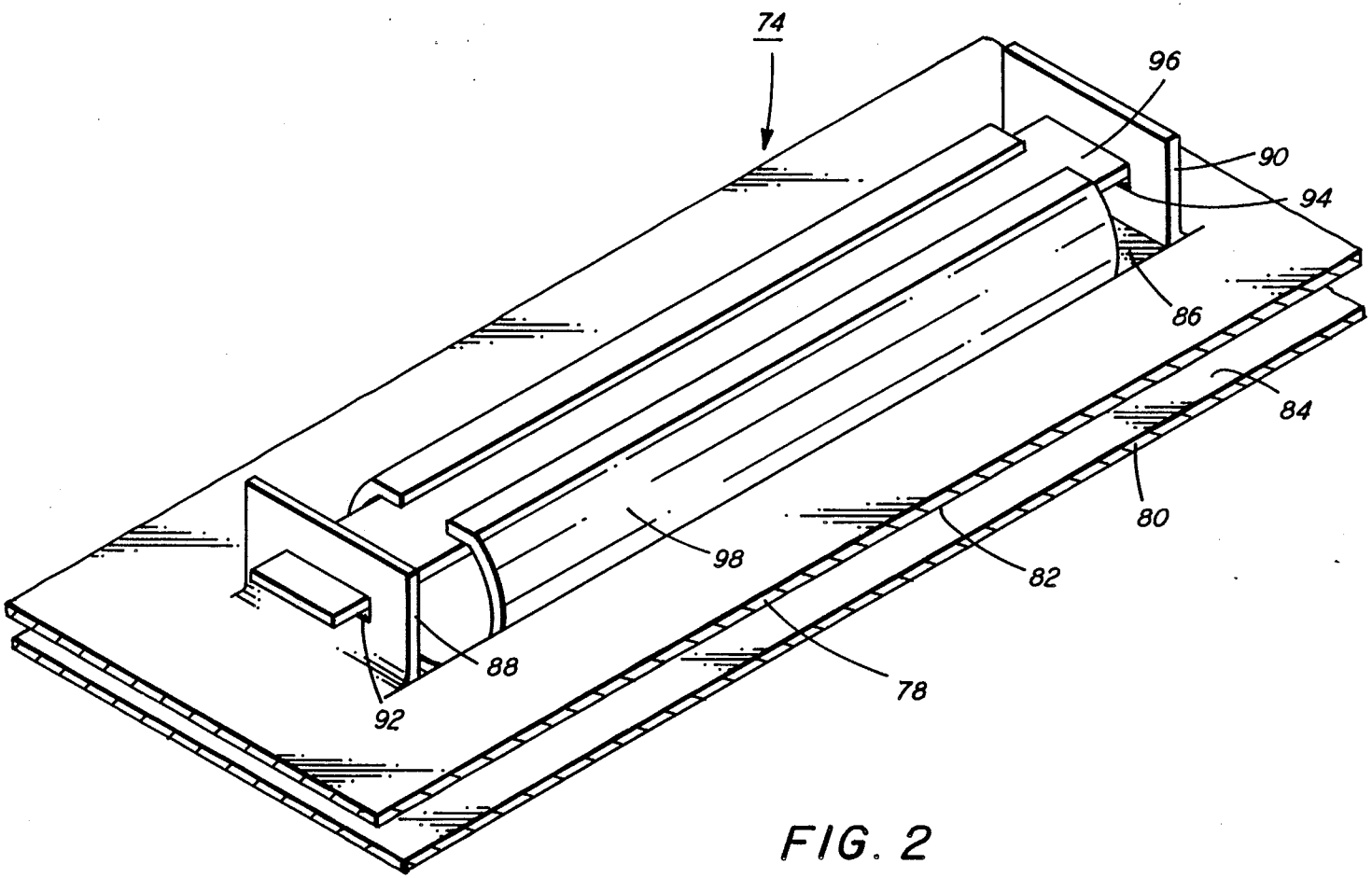

Other aspects of the present invention will become apparent as the following description proceeds and upon reference to the drawings, in which:

FIG. 1 is a schematic elevational view depicting an illustrative electrophotographic printing machine incorporating the apparatus for guiding and advancing a copy sheet therein; and FIG. 2 is a schematic perspective view showing, in greater detail, the apparatus for guiding and advancing the copy sheet along the sheet path of the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numeral have been used throughout to identify identical elements. FIG. 1 schematically depicts an electrophotographic printing machine incorporating the features of the present invention therein. It will become evident from the following discussion that the features of the present invention may be equally well suited for use in a wide variety of devices and is not specifically limited in its application to the particular embodiment shown herein.

Referring now to FIG. 1, an exemplary electrophotographic printing machine capable of producing a stream of copy sheets having information copied on either one side only, simplex sheets, or on both sides, duplex sheets is depicted therein. A recirculating document feeder 10 is shown positioned on the printing machine. Document feeder 10 is adapted to feed original documents, in seriatim, for copying. Usually, document feeder 10 operates in a collating mode wherein original documents are fed, in seriatim, from a stack in a tray at the top of the feeder for copying one at a time for each circulation and return to the stack. The original documents are placed in the feeder in a pre-determined page sequential order. For example, the first page is on top of the stack and the last page is at the bottom of the stack. The last original document is fed first and then returned to the top of the stack. The printing machine operator can control operation of the electrophotographic printing machine and its related apparatus through an operator control panel designated generally by the reference numeral 12. To this end, the machine operator can determine whether a set of copies will be stapled, adhesively bound or have both operations performed thereon. The set of copy sheets is received in a compiler tray of a finisher tray. The completed set of copy sheets or booklet is then advanced through the finishing module to be stapled or adhesively bound, or to have a combination of both of the foregoing operations performed thereon. In all cases, either the original document or the copy sheet must be controlled in a predetermined path of movement. The apparatus of the present invention guides and advances the copy sheet and/or original document.

The electrophotographic printing machine employs a belt 14 having a photoconductive surface 16 deposited on a conductive substrate 18. Preferably, photoconductive surface 20 is made from a selenium alloy with conductive substrate 22 being made from an aluminum alloy. Other suitable photoconductive materials, e.g. organic materials and conductive substrates, e.g. Mylar, a trademark of the Dupont Corporation, may also be employed. Belt 14 moves in the direction of arrow 20 to advance successive portions of photoconductive surface 16 sequentially through the various processing stations disposed about the path of movement thereof. Belt 14 is entrained about stripping roller 22, tensioning roller 24 and drive roller 26. Stripping roller 22 is mounted rotatably, so as to rotate with belt 14. Tensioning roller 24 is resiliently urged against belt 14 to maintain belt 14 under the desired tension. Drive roller 26 is rotated by motor 28 coupled thereto by suitable means, such as a drive belt. As roller 26 rotates, it advances belt 14 in the direction of arrow 20.

Initially, a portion of the photoconductive surface passes through charging station A. At charging station A, a corona generating device indicated generally by the reference numeral 30, charges photoconductive surface 16 to a relatively high, substantially uniform potential.

Next, the charged portion of photoconductive surface 16 is advanced through imaging station D. At imaging station D, a document handling unit 10 is positioned over platen 32 of the printing machine. The document handling unit 10 sequentially feeds documents from a stack of documents placed by the operator face up in a normal forward collated order in the document stacking and holding tray. A document feeder, located below the tray forwards the bottom document in the stack to a pair of take away rollers. The bottommost sheet is then fed by the rollers through the document guide to a feed roll pair and belt. The belt, entrained about a pair opposed spaced rollers, advances the document onto platen 32. After imaging, the original document is fed from the platen by the belt to guide and feed roll pairs. The document then advances into an inverter mechanism or back to the document stack through the feed roll pairs. A position gate is provided to divert the document either to the inverter or to the feed roll pair. Imaging of a document is achieved by lamps 34 which illuminate the document on platen 32. Light rays reflected from the document are transmitted through lens 36. Lens 36 focuses the light image of the original document onto the charged portion of photoconductive surface 16 of belt 14 to selectively dissipate the charge thereon. This records an electrostatic latent image on photoconductive surface 16 which corresponds to the informational areas contained within the original document. Thereafter, belt 10 advances the electrostatic latent image recorded on photoconductive surface 16 to development station C.

With continued reference to FIG. 1, at development station C, a pair of magnetic brush developer rollers, indicated generally by the reference numerals 38 and 40 advance developer material into contact with the electrostatic latent image. The latent image attracts toner particles from the carrier granules of the developer material to form a toner powder image on the photoconductive surface of belt 14. Belt 14 then advances the toner image to transfer station D.

At transfer station D, a copy sheet is moved into contact with the powder image. Transfer station D includes a corona generating device 42 which sprays ions onto the backside of the copy sheet. This attracts the toner powder image from photoconductive surface 16 to the sheet. After transfer, conveyor 44 advances the sheet to fusing station E.

Fusing station E includes a fuser assembly, indicated generally by the reference numeral 46, which permanently affixes the transferred powder image to the copy sheet. Preferably, fuser assembly 46 includes a heated fuser roller 48 and a back-up roller 50 with the powder image contacting fuser roller 48. In this manner, the powder image is permanently affixed to the copy sheet.

After fusing, the copy sheets are fed to gate 52 which functions as an inverter selector. Depending upon the position of gate 52, the copy sheet is deflected into sheet inverter 54 or bypasses inverter 54 and is fed directly to a second decision gate 56. At gate 56, the sheet is in a face up orientation with the image side which has been fused up. If inverter path 58 is selected, the opposite is true, i.e. the last printed side is face-down. Decision gate 56 either deflects the sheet directly into an open output tray 58 or deflects the sheet into a transport path which carries it to a third decision gate 60. Gate 60 either passes the sheet directly into a finishing station (not shown) or onto a duplex inverter roll 62. Roll 62 inverts and stacks the sheets to be duplexed in duplex tray 64 when gate 60 so directs. Duplex tray 64 provides an intermediate or buffer storage for those sheets which have been printed on one side, and on which an image will be printed subsequently on the side opposed thereof, i.e. the sheets being duplexed. Due to sheet inversion by roller 62, the buffer sheets are stacked in tray 64 face-down. They are stacked in a duplex tray 64 on top of one another in the order in which they are copied.

In order to complete duplex copying, the simplex sheets in tray 64 are fed, in seriatim, by bottom feeder 66 from tray 64 back to transfer station D via conveyors 68. Conveyers 68 are also employed to receive successive uppermost sheets from stacks 70 and 72 thereof. Thus, the unused copy sheet is advanced from either stack 70 or stack 72 onto conveyers 68 for subsequent transportation to transfer station D. It is thus clear that the duplex sheet is fed through the same paper path as the simplex sheet. Conveyers 68 advance the copy sheet which either has one or no images thereon, to the sheet advancing and guiding apparatus of the present invention, indicated generally by the reference numeral 74. While the sheet advancing and guiding apparatus of the present invention is shown as being used in a copy sheet path, one skilled in the art will appreciate that the same apparatus may be employed to guide and advance original documents in a document handling system. The detailed structure of the sheet advancing and guiding apparatus 74 will be described hereinafter with reference to FIG. 2.

Invariably, after the copy sheet is separated from photoconductive surface 16 of belt 14 some residual particles remain adhering thereto. These residual particles are removed from photoconductive surface 16 at cleaning station F. Cleaning station F includes a rotatably mounted fibrous or electrostatic brush 76 in contact with photoconductive surface 16 of belt 14. The particles are cleaning from photoconductive surface 16 of belt 14 by the rotation of brush 76 in contact therewith. Subsequent to cleaning, a discharge lamp (not shown) floods photoconductive surface 16 with light to dissipate any residual electrostatic charge remaining thereon prior to the charging thereof for the next successive imaging cycle.

Controller 12 is preferably a programmable microprocessor which controls all of the machine functions heretofore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine console selected by the operator. Conventional sheet path sensors or switches may be utilized for keeping track of the position of the documents and the copy sheets. In addition, controller 12 regulates the various positions of the decision gates depending upon the mode of operation selected. A detailed operation of the sheet guide apparatus will be described hereinafter with reference to FIG. 2, the general operation of sheet guiding apparatus 74 will now be described.

As shown in FIG. 2, sheet guiding apparatus 74 includes opposed spaced baffles 78 and 80. Baffles 78 and 80 are made preferably from sheet metal having generally planar surfaces 82 and 84 opposed from one another. A slot 86 is formed in baffle 78. Tabs 88 and 90 are bent up from baffle 78 and are formed from a portion extending along slot 86. Tabs 88 and 90 have slots 92 and 94 formed therein. A leaf spring 96 is mounted in slots 92 and 94 of tabs 88 and 90, respectively. An arcuate member, i.e. partially cylindrical member, 98 is mounted slidably on leaf spring 96. Preferably, arcuate member 98 is made from a material having a low coefficient of sliding friction. Arcuate member 98 is mounted stationarily on leaf spring 96. Leaf spring 96 resiliently urges a portion of arcuate member 98 through slot 86 into contact with a sheet passing between baffle 78 and 80 into the nip defined by arcuate member 98 and drive roller 100 (FIG. 1). Thus, arcuate member 98 acts as a non-rotating idler. Preferably, arcuate member 98 is made from ultra high molecular weight polyurethane. This material has a low coefficient of sliding friction. Drive roller 100 (FIG. 1) is rotated by suitable means such as a motor coupled thereto by a drive belt or gearing system.

Referring once again to FIG. 1, as the copy sheet is advanced by rollers 102 and 104 into the gap between baffle plate 78 and 80, the leading edge thereof passes into the nip defined by drive roller 100 and non-rotating arcuate member 98. Drive roller 100 causes the paper to continue to advance in the direction of arrow 106 so as to be guided by baffle 108 to transfer station D where the toner powder image is transferred thereto.

In recapitulation, it is clear that the electrophotographic printing machine includes a sheet guiding and advancing apparatus which employs a non-rotating arcuate member, i.e. idler, resiliently urged into engagement with a sheet moving through a nip defined by the non-rotating idler and the drive roller so as to press the sheet against the drive roller. Baffles associated with the non-rotating idler and the drive roller guide the advancing sheet to and from the nip. The non-rotating idler is made from a material having a low coefficient of sliding friction. A system of this type eliminates the requirement for a rotating idler roller. The non-rotating idler has no moving parts and thus has a greater life than a rotating idler roller. Furthermore, there are significant cost savings in that a rotating idler roller requires a shaft, roller and clips to secure the roller to the shaft. None of the foregoing are required by a non-rotating idler. The non-rotating idler of the present invention has been tested for 482,000 cycles with only minor wear. Furthermore, other tests have been conducted indicating that the life of a non-rotating idler is in excess of at least 440 hours. In view of the foregoing, it is believed that a non-rotating idler significantly reduces the complexity and cost of a sheet guiding apparatus.

It is, therefore, evident that there has been provided in accordance with the present invention a sheet guiding and advancing apparatus which fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An apparatus for guiding and advancing a sheet, including:

a drive roller, a non-rotating, arcuate member arranged to be positioned closely adjacent to said drive roller to define a nip with said arcuate member being made from a material having a low coefficient of sliding friction;

means for resiliently urging said arcuate member into engagement with the sheet to press the sheet against the drive roller to advance the sheet through the nip; and means for guiding the sheet into and out of the nip, said guiding means includes at least a first member having a generally planar surface with a slot therein, said arcuate member being arranged to have at least a portion thereof extending through the slot to define the nip.

2. An apparatus according to claim 1, wherein said first member includes a pair of opposed, spaced tabs on opposed ends of the slot therein for supporting said arcuate member.

3. An apparatus according to claim 2, wherein said resilient means includes a leaf spring having said arcuate member mounted thereon, said leaf spring being mounted in the opposed spaced tabs on opposed sides of the slot in said member.

4. An apparatus according to claim 3, wherein said guide means includes a second member having a generally planar surface opposed from the generally planar surface of said first mentioned member to form a space therebetween for receiving the sheet and guiding the sheet to the nip.

5. An apparatus according to claim 4, wherein said first mentioned member and said second member are made made from sheet metal.

6. An apparatus according to claim 5, wherein said arcuate member is made preferably from an ultra high molecular weight polyethylene.

7. An electrophotographic printing machine of the type having a sheet path for guiding and advancing a copy sheet to the processing stations disposed therein, wherein the improvement includes:

a drive roller;

a non-rotating, arcuate member arranged to be positioned closely adjacent to said drive roller to define a nip, said arcuate member being made from a material having a low coefficient of sliding friction;

means for resiliently urging said arcuate member into engagement with the sheet to press the sheet against the drive roller to advance the sheet through the nip; and means for guiding the sheet into and out of the nip, said guiding means includes at least a first member having a generally planar surface with a slot therein, said arcuate member being arranged to have at least a portion thereof extending through the slot to define the nip.

8. A printing machine according to claim 7, wherein said first member includes a pair of opposed, spaced tabs on opposed ends of the slot therein for supporting said arcuate member.

9. A printing machine according to claim 8, wherein said resilient means includes a leaf spring having said arcuate member mounted thereon, said leaf spring being mounted in the opposed spaced tabs on opposed sides of the slot in said member.

10. A printing machine according to claim 9, wherein said guide means includes a second member having a generally planar surface opposed from the generally planar surface of said first mentioned member to form a space therebetween for receiving the sheet and guiding the sheet to the nip.

11. A printing machine according to claim 10, wherein said first mentioned member and said second member are made made from sheet metal.

12. A printing machine according to claim 11, wherein said arcuate member is made preferably from an ultra high molecular weight polyethylene.

* * * * *